US009038706B2

(12) United States Patent
Hillier

(10) Patent No.: US 9,038,706 B2
(45) Date of Patent: May 26, 2015

(54) CASTING OF INTERNAL FEATURES WITHIN A PRODUCT

(75) Inventor: Steven M. Hillier, Manchester (GB)

(73) Assignee: ROLLS-ROYCE PLC, London (GB)

( * ) Notice: Subject to any disclaimer, the term of this patent is extended or adjusted under 35 U.S.C. 154(b) by 518 days.

(21) Appl. No.: 12/953,963

(22) Filed: Nov. 24, 2010

(65) Prior Publication Data

US 2011/0143090 A1 Jun. 16, 2011

(30) Foreign Application Priority Data

Dec. 15, 2009 (GB) ..... 0921818.1

(51) Int. Cl.
*B22C 9/10* (2006.01)

(52) U.S. Cl.
CPC ..... *B22C 9/103* (2013.01); *Y10T 428/24331* (2015.01)

(58) Field of Classification Search
CPC ..... B22C 9/103
USPC ..... 164/9, 30, 31, 32, 112, 132, 137, 332, 164/369
See application file for complete search history.

(56) References Cited

U.S. PATENT DOCUMENTS

| | | | | |
|---|---|---|---|---|
| 1,586,321 | A | 5/1926 | Newport | |
| 4,691,754 | A * | 9/1987 | Trumbauer et al. | 164/9 |
| 4,986,333 | A | 1/1991 | Gartland | |
| 5,853,044 | A * | 12/1998 | Wheaton et al. | 164/516 |
| 6,068,806 | A | 5/2000 | Dietrich | |
| 6,244,327 | B1 * | 6/2001 | Frasier | 164/34 |
| 6,637,500 | B2 * | 10/2003 | Shah et al. | 164/369 |
| 2002/0051706 | A1 | 5/2002 | Haehnle et al. | |
| 2003/0159893 | A1 | 8/2003 | Tironi | |
| 2004/0060964 | A1 | 4/2004 | Kottilingam et al. | |
| 2006/0021730 | A1 * | 2/2006 | Marcin, Jr. | 164/122.1 |
| 2007/0246183 | A1 * | 10/2007 | Beals et al. | 164/45 |

FOREIGN PATENT DOCUMENTS

| | | |
|---|---|---|
| EP | 0 715 913 A1 | 6/1996 |
| EP | 0 750 957 A1 | 1/1997 |
| EP | 0 904 872 A1 | 3/1999 |
| EP | 1 543 896 A2 | 6/2005 |
| EP | 1 604 753 A1 | 12/2005 |
| EP | 1 923 152 A1 | 5/2008 |
| JP | A-52-57021 | 5/1977 |

(Continued)

OTHER PUBLICATIONS

Great Britain Search Report issued in Application No. 0921818.1; dated Mar. 30, 2010.

(Continued)

*Primary Examiner* — Kevin P Kerns
(74) *Attorney, Agent, or Firm* — Oliff PLC

(57) ABSTRACT

A method of forming a cast product (30) by providing a core (52) having a plurality of sections (54) and one or more gaps (55) there-between. The core further includes an insert member (60) spanning the gap (55) between adjacent sections (54). The core (52) is located within a mold (68) and a liquid phase material is introduced into gap (55) between the core sections. The liquid phase material is solidified in the gap so as to form a cast feature of a resulting solid product and the core sections (54) are removed from the solid product (30) such that the insert member (60) remains securely held within the feature (74).

21 Claims, 3 Drawing Sheets

(56) References Cited

FOREIGN PATENT DOCUMENTS

| | | |
|---|---|---|
| JP | A-55-68168 | 5/1980 |
| JP | A-2-123260 | 5/1990 |
| JP | A-7-060402 | 3/1995 |
| JP | A-2000-034950 | 2/2000 |
| JP | A-2004-216395 | 8/2004 |
| JP | A-2007-061891 | 3/2007 |

OTHER PUBLICATIONS

European Search Report issued in Application No. 10 19 2345; Dated May 23, 2011.

* cited by examiner

CASTING OF INTERNAL FEATURES WITHIN A PRODUCT

BACKGROUND OF THE INVENTION

The present invention relates to cast products having internal features and more particularly, although not exclusively, a casting process for producing products having cooling passages therein.

There are a number of machine components for which it is necessary to provide internal features such as cavities or passages. The complexity of such internal features provides a technical challenge when the intended component is manufactured by casting.

The provision of cooling passages for components which operate in use within high temperature environments is one example in which such complex internal passages are required. Cooling of components is of particular importance for high temperature gas turbine engines in order to ensure that components within the engine are maintained at a suitable operational temperature without deterioration to performance. It is widely acknowledged that the use of internal cooling channels can allow components to operate effectively in hot environments which exceed the melting temperature of the component material.

It is known to provide cooling arrangements in which coolant flow cascades between a plurality of cooling chambers in order to maximise the cooling efficiency and effect. The cascading of cooling flow is used to ensure successive impingement of the coolant flow onto surfaces to be cooled. This technique may be suitable for a number of different types of components and is applied to rotor rims for turbines in a gas turbine engine. Cooling in this manner typically requires a plurality of successive cooling chambers to be defined by internal wall formations in the component. Flow between those chambers is permitted by the provision of openings in the walls such that flow entering a first chamber passes into a second chamber via said openings and then into a further chamber from the second chamber by virtue of further openings. The openings are arranged such that the flow impinges on the surfaces to be cooled in the relevant chambers prior to passing into another chamber.

Whilst such cooling passages are preferable from an operational point of view, the formation of such chambers and openings by way of casting or moulding is a complex process. In an investment or 'lost wax' casting process, a core is required which defines the shape of the interior of the component. The core is removed to leave the negative internal space within the component once formed. However a problem exists in that exit apertures must be provided in the component in order to allow removal of the core.

Additional problems arise due to the intricate nature of the core used to define the internal features of the component. The shape of a core which is suited to providing cooling chambers separated by relatively thin walls typically results in a delicate structure which may not be capable of supporting its own weight. A support in the form of a spine is often required to hold the core bodies in a fixed relative position and to maintain tolerances relative to the cast.

The spine is a manufacturing feature and, once removed, leaves unwanted apertures in the final component.

Exit apertures due to removal of a spine and/or the core itself are undesirable in the final component and can cause short circuits or otherwise prevent correct operation of the internal cooling network. Accordingly these passages need to be closed in the final component. Conventional methods of closing the exit apertures involve brazing or welding of closures, which methods are time consuming and can cause detrimental thermal stresses in the final component. Repeated thermal loading of the component can lead to problems on account of thermal stresses, such as cracking or component failure.

SUMMARY OF THE INVENTION

It is an aim of the present invention to provide a method of casting products which can provide internal features in a product in an improved manner. It is a further aim of the present invention to provide a cast product and/or articles for use in the casting of a product which mitigate the problems described above.

According to one aspect of the present invention there is provided a method of forming a cast product comprising: providing a core having a plurality of sections and one or more gaps there-between, wherein the core comprises an insert member spanning the gap between adjacent sections of the core; locating the core within a mould; introducing a liquid phase material into the gap between the core bodies in the mould; allowing the liquid phase material to solidify in the gap so as to form a feature of a resulting solid product; and removing the core sections from the solid product such that the insert member remains securely held within the feature.

According to one embodiment, the feature comprises an internal feature in the resulting product. In one embodiment, the cast features are internal walls within the resulting product. The feature may comprise a wall, which may be provided between internal cavities or chambers of the product.

The insert member may comprise a material which is different to the material of the remainder of the core. The insert member may be formed of a first material and the core sections are formed of a second material, wherein the first and second materials are different. The insert member may comprise or consist of a metal or ceramic material. The core sections may be formed of a ceramic material.

In one embodiment the core sections define internal cavities within the resulting product. The plurality of sections may comprise a plurality of first sections and the core may comprises a plurality of further sections. The further sections may depend from the first sections and may be connected thereto by one or more pedestals. The first sections, the further sections and the pedestals may be formed of the same material. The further sections may be of smaller volume than the first sections.

The core may define a network of internal cooling cavities in the resulting product.

The insert member may comprise opposing retaining features, shaped to retain the insert member in the feature of the solid product once cast. The insert member may comprise a neck region and opposing retaining formations depending therefrom. The insert member may comprise a tapered portion and may comprise a pair of opposingly tapered portions.

In one embodiment, the core comprises one or more retaining formations for positioning the core within the mould. The retaining formations may comprise arm members depending outwardly there-from and the arm members may be received within corresponding locating formations in the mould. The retaining members may be arranged so as to suspend the core within the mould.

According to one embodiment, the resulting product is a gas turbine engine component.

According to a second aspect of the invention, there is provided a mould core for use in an investment casting process, the core comprising: a plurality of sections spaced by a gap there-between and an insert member having a first portion located in a first section and an opposing portion located in a second core section so as to span the gap there-between; wherein the insert member is formed of a material which is different to the material of the core sections.

According to a third aspect of the invention, there is provided a cast product comprising a plurality of internal cavities and one or more internal walls there-between, said cavities in combination defining an internal cooling passage within the product, the one or more internal walls comprising an aperture having an insert member therein, said insert member comprising a neck portion seated within the aperture and opposing retaining portions depending outwardly from said neck portion so as to retain the insert member within the wall.

The insert member may be formed of a single solid body.

According to a fourth aspect of the invention, there is provided a gas turbine engine comprising a product according to the third aspect.

According to a fifth aspect of the present invention, there is provided an insert member for use in the creation of cast product according to the first aspect.

The terms 'cast' or 'casting' as used herein should be construed as relating to the forming of a product whereby liquid phase material is allowed to solidify within a cast, mould, shell, die or similar formation so as to define the shape of the solidified material therein.

Any of the optional features described herein in relation to any one aspect or embodiment of the invention is applicable to all further aspects or embodiments wherever practicable.

DESCRIPTION OF THE DRAWINGS

One or more working embodiments of the present invention are described in further detail below by way of example with reference to the accompanying drawings, of which.

DETAILED DESCRIPTION

Figure 1:
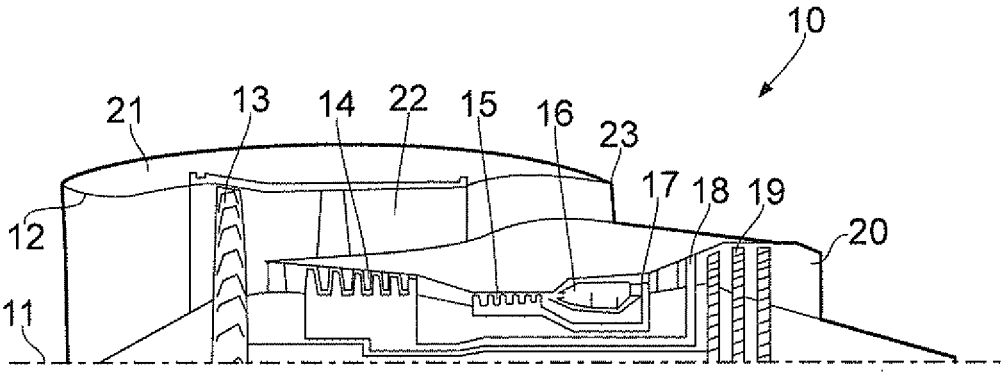
FIG. 1 shows a half longitudinal section of a gas turbine engine to which the invention may be applied.

With reference to FIG. 1, a ducted fan gas turbine engine generally indicated at 10 has a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and a core engine exhaust nozzle 20. A nacelle 21 generally surrounds the engine 10 and defines the intake 12, a bypass duct 22 and a bypass exhaust nozzle 23.

The gas turbine engine 10 works in a conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high, intermediate and low-pressure turbines 17, 18, 19 respectively drive the high and intermediate pressure compressors 15, 14 and the fan 13 by suitable interconnecting shafts.

Alternative gas turbine engine arrangements may comprise a two, as opposed to three, shaft arrangement and/or may provide for different bypass ratios. Other configurations known to the skilled person include open rotor designs, such as turboprop engines, or else turbojets, in which the bypass duct is removed such that all air flow passes through the core engine. The various available gas turbine engine configurations are typically adapted to suit an intended operation which may include aerospace, marine, power generation amongst other propulsion or industrial pumping applications.

The present invention is particularly suited to components which may be manufactured using investment casting techniques, which may be otherwise referred to a 'lost wax' castings. Such components may be mounted in the vicinity of the turbines 17 to 19—particularly the high pressure turbine 17—and may comprise seal segments which form a closely-fitting rim or ring about the turbine or else vanes, such as nozzle guide vanes immediately downstream of the turbine.

Figure 2A:
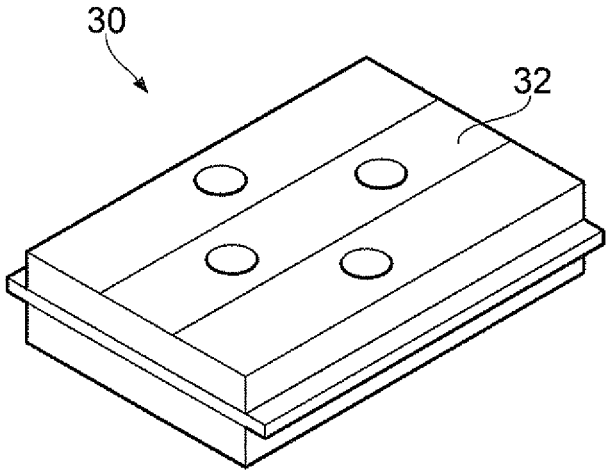
FIG. 2A shows a three-dimensional view of a turbine seal segment according to the present invention.

FIG. 2 shows an example of a component which may be formed according to the present invention in the form of a turbine seal segment 30. The component 30 has a cast body 32 in which are defined a plurality of internal features or structures in the form of walls 34 and 35. A first set of internal walls 34 depend inwardly from outer wall 36 so as to define a series of larger internal cavities or chambers 38A, 38B, 38C. A second set of internal walls 35 depend inwardly from external wall 40 so as to define a second series of relatively smaller internal chambers 42A, 42B, 42C. The first 38A, 38B, 38C and second 42A, 42B, 42C sets of internal chambers are separated by internal wall 44.

Internal wall 44 extends generally laterally across the component 30 between opposing side walls, whereas the internal walls 34 and 35 are generally perpendicular thereto, so as to define generally right-angled internal chambers 38A, 38B, 38C and 42A, 42B, 42C. Additional formations in the form of turbulators are cast into the walls of the smaller internal chambers 42A, 42B, 42C to promote heat transfer between the chamber walls and a coolant flowing there-through.

Figure 2B:
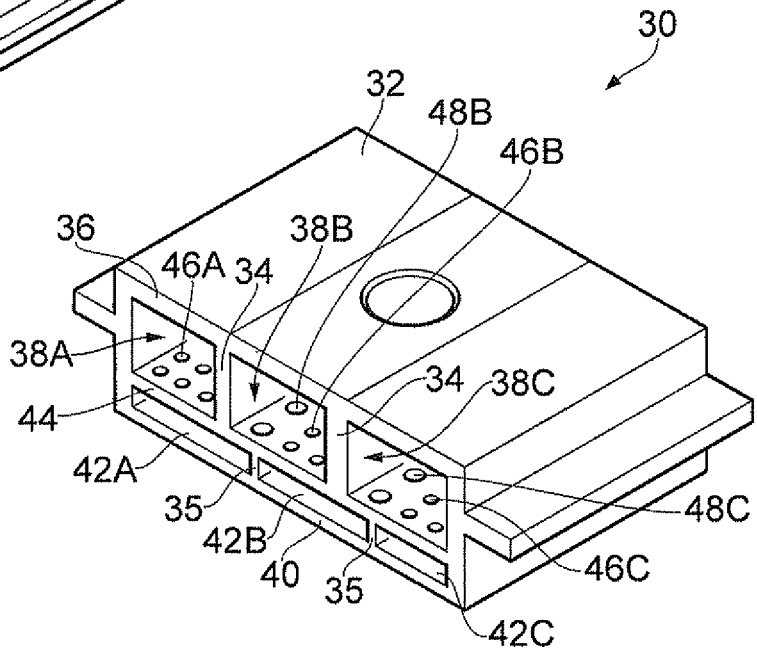
FIG. 2B shows a cut-away three-dimensional view of the seal segment of FIG. 2A.

A plurality of apertures 46A, 46B, 46C and 48A, 48B, 48C are provided in the internal wall 44. The apertures 46A, 46B, 46C provide inlets into the second chambers 42A, 42B, 42C from the relevant first chamber 38A, 38B, 38C, whereas the apertures 48A, 48B; 48C provide an outlet from the second chambers 42A, 42B, 42C to the relevant first chamber 38A, 38B, 38C. With reference to FIG. 2B, coolant can thus flow from the left-most chamber 38A, 38B, 38CA via apertures 46A, 46B, 46CA into the chamber 42A, 42B, 42CA therebeneath. The coolant exits chamber 42A, 42B, 42CA into the central chamber 38A, 38B, 38CB via apertures 48A, 48B, 48CB. Coolant enters chamber 42A, 42B, 42CB from central chamber 38A, 38B, 38CB via apertures 46A, 46B, 46CB and passes there-along prior to exiting into chamber 38A, 38B, 38CC via apertures 48A, 48B, 48CC. From chamber 38A, 38B, 38CC, coolant can enter chamber 42A, 42B, 42CC via apertures 46A, 46B, 46CC.

Internal cooling of component in this manner by passage of coolant into and from successive chambers may be referred to herein as cascade cooling or cascade impingement cooling. Using this technique coolant undergoes multiple passes to and from a surface to be cooled (in this case external wall 40) prior to exiting the component. This has a beneficial impact on cooling efficiency.

Figure 3:
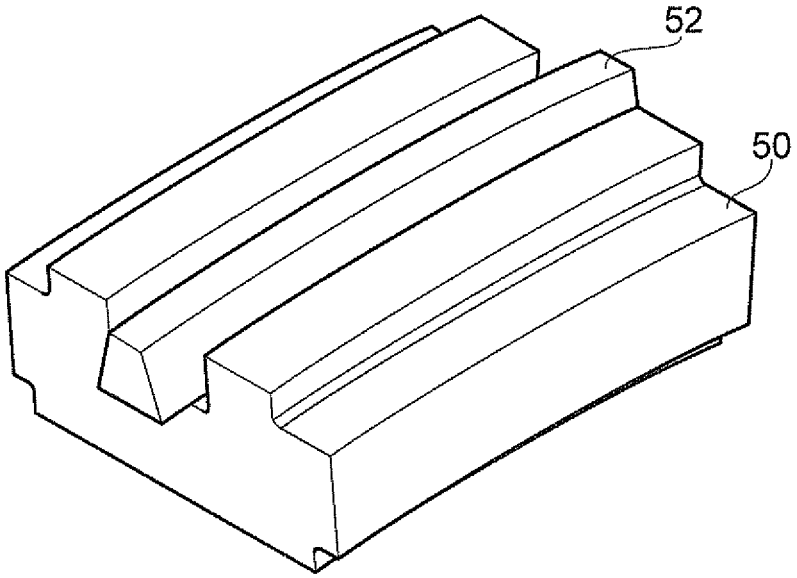
FIG. 3 shows a three-dimensional view of a body and core for creation of a turbine seal segment according to the present invention.
Figure 4:
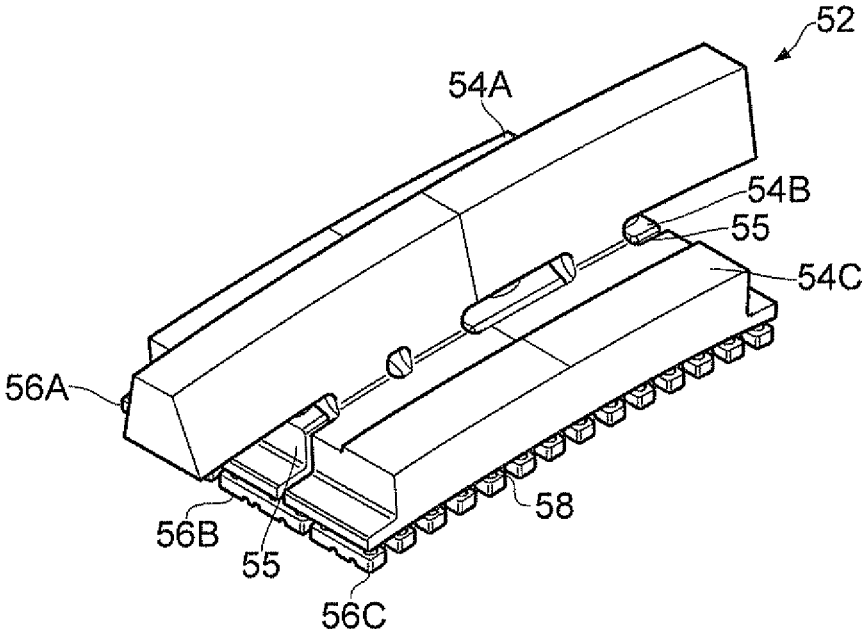
FIG. 4 shows a three-dimensional view of a core for creation of internal formation within the seal segment of FIG. 2.

Turning now to FIGS. 3 and 4, investment casting is used to form body 30 within a mould (not shown). The material 50 from which the body 30 is formed is cast about a core member 52 as shown in FIG. 3. In this embodiment, the core member 52 is substantially formed of a ceramic material although other known core materials may be used. The core member 52 is removed from the material 50 once cast using conventional techniques as would be known to the person skilled in the art. The remaining material 50 is then machined and/or otherwise processed and/or treated in order to result in the component 30.

The core member 52 is shown in isolation in FIG. 4. The core member 52 comprises a plurality of sections which form the corresponding internal cavities in the final component. In this example, the sections 54A, 54B and 54C respectively form the chambers 46A, 46B, 46CA, 46A, 46B, 46CB and 46A, 46B, 46CC in the final component. The sections 54A, 54B and 54C are spaced by gaps 55 which form walls 34 in the final component. In order to provide the cascade cooling effect described above, it is preferable that the gaps 55 are continuous such that walls 34 have no apertures therein, which would serve to short-circuit the cascade cooling gas path in the final component.

The series of sections 56A, 56B and 56C respectively form the individual cooling passageways 42A, 42B, 42CA, 42A, 42B, 42CB and 42A, 42B, 42CC as shown in FIG. 2B. The sections 56A, 56B, 56C are suspended from sections 54A, 54B, 54C by ties or pedestals 58 formed of the same core material, which, when removed, form the apertures 46A, 46B, 46C and 48A, 48B, 48C in the final component.

The intricate and delicate nature of the core 52 results in a need to support the core sections throughout at least some stages of the component manufacturing process.

Figure 5:
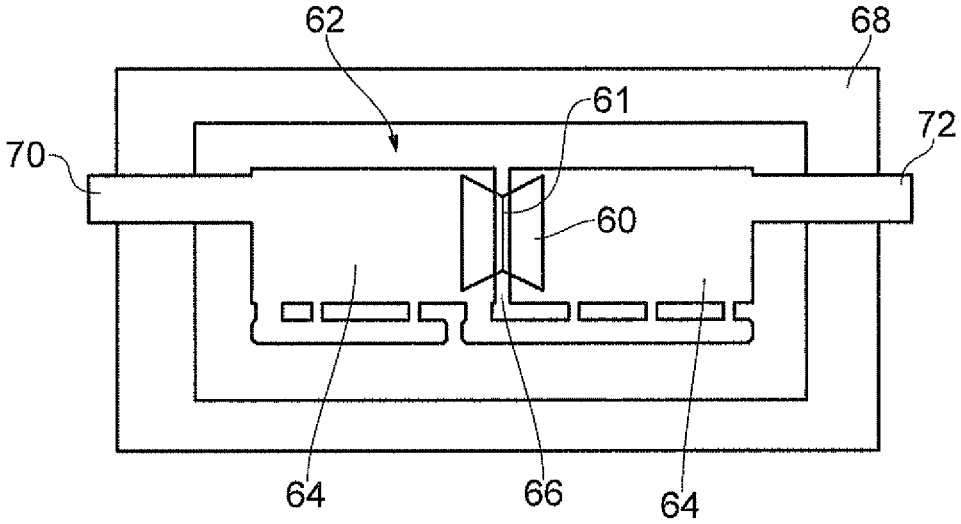
FIG. 5 shows a cross section of a core according to a further embodiment of the present invention; and, FIG. 6 shows a sectional view of a cast product with cast members in place.
Figure 6:
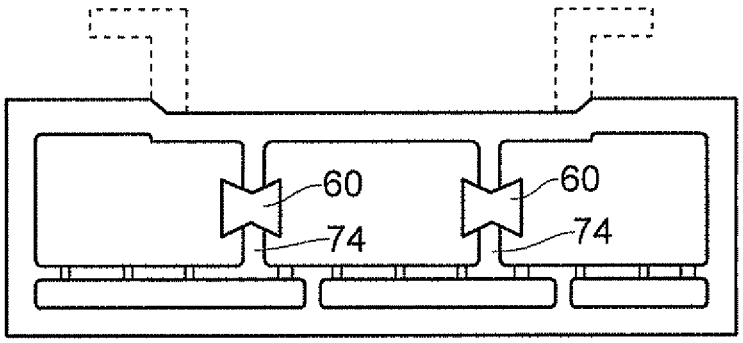

This is achieved using one or more core insert members 60 as shown in FIGS. 5 and 6, which span the gaps between core sections and serve to hold the core sections in a fixed relative position.

An exemplary cross section of a core 62 which comprises two adjacent core sections 64, separated by a gap 66, is shown in FIG. 5. This embodiment would produce a component having two main internal chambers, rather than the three chambers 38A, 38B, 38C shown in FIG. 2. The invention may be applied to a core having two or more core sections and a corresponding component produced thereby to have two or more internal chambers.

The core 62 is shown held within a mould, which is depicted schematically at 68. The core 62 has support features in the form of arms 70 and 72 depending outwardly therefrom and which are received in corresponding location formations in the mould 68. The core insert members 60 also help to maintain tolerances to the cast surface in conjunction with the arms 70, 72 which project out of the casting.

However, unlike the provision of a continuous spine through the core 62, the core insert member 60 is formed of a different material to the core 62 and associated arms 70, 72. In this embodiment, the insert member 60 is formed of a Zirconia or Alumina material although any material which is capable of withstanding the casting process/melt temperatures may be used provided it meets the functional requirements of the component in which it is to be inserted.

The core insert member 60 is doubly tapered in shape so as to form a neck region 61 at its centre which is smaller in dimension than its opposing sides. The insert member is generally circular in plan such that its shape may be likened to a unison of two opposing frusto-conical halves. The insert member may otherwise be described as being generally hourglass shaped.

With the core 62 and insert member 60 therein held within the mould 68, molten material can be allowed to enter the mould 68 to thereby form the component body about the core 62. It will be appreciated that various optional methods for casting are available which may include casting within a vacuum, single crystal casting or directionally solidified castings, any of which may be use din conjunction with the present invention.

Once cast, the component is removed from the mould 68 and the core removed there-from using conventional techniques. However the core insert member 60, being formed of a different material to that of the core, is maintained within the internal wall of the core body. The cast component can be machined and otherwise treated as required for use. The insert member 60 remains in the core throughout the casting process and is then ultimately retained by the metal cast around it.

An example of such a component is shown in section in FIG. 6, in which the core insert members 60 are held fast within the cast internal walls 74. The shape of the members 60 ensure that they cannot slide out from the walls in which they are cast. Furthermore, the dual taper of the members ensure that the insert members are resilient to operational fluid pressures which may be applied to the component in use.

In the event that the component may undergo heating during operation, the thermal expansion properties of the members 60 are typically closely matched to that of the component material. Any slight discrepancy therein may be accommodated for by the dual taper of the member, such that the member cannot come loose. Whilst it is acknowledged that a portion of the member 60 will protrude form the wall 74 into the internal cavity, such protrusion is not considered to cause undue detriment to the efficiency of the cascade cooling circuit.

The taper and dimensions of the core insert member may be tailored to suit the operational requirements for the end component. For example the taper may be increased for components which will undergo relatively high coolant pressure loading in use.

The insert member described above provides a solution to the problems associated with removable/soluble core investment casting, which is effective in terms of cost and function. Further specific advantages of the invention are considered to include:

formation of a strong link between the core bodies;

retention of insert member within the internal wall is favoured by shrinkage of metal during casting process;

time and cost penalties of high tolerance machining operations are avoided;

potential scrap caused by high tolerance machining operations is avoided;

inspection requirements are reduced;

a consistently air-tight barrier between core bodies is provided; and, the location of the insert member in the wall is not critical since it is a free, cast-in feature.

In addition to turbine seal segments, the invention may be applied to nozzle guide vanes or other cast components for which internal features require the use of delicate and/or complex cores.

The invention claimed is:

1. A method of forming a cast product comprising:

providing a core having a plurality of sections and one or more gaps there-between, the core including a first insert member spanning the gap between adjacent sections of the core, both ends of the first insert member extending partially into adjacent sections of the core, and the first insert member being directly connected between the adjacent sections of the core so as to hold the adjacent sections in a fixed relative position, the plurality of sections being formed of a ceramic material;

locating the core within a mould;

introducing a liquid phase metal material into the gap between the core sections;

solidifying the liquid phase metal material in the gap so as to form a cast feature of a resulting solid product; and removing the core sections from the solid product to form cavities therein such that the first insert member remains securely held within the feature located between said cavities.

2. The method according to claim 1, wherein the first insert member is formed substantially of a first material and the core sections are formed substantially of a second material, wherein the first and second materials are different.

3. The method according to claim 1, wherein the first insert member is formed of a metal.

4. The method according to claim 1, wherein the cast feature is an internal wall within the resulting product.

5. The method according to claim 1, wherein the core sections define opposing internal cavities within the resulting product such that the cast feature is formed between the opposing internal cavities.

6. The method according to claim 1, wherein the plurality of sections comprise a plurality of first sections and the core comprises a plurality of further sections depending from said first sections.

7. The method according to claim 1, wherein the core defines a network of internal cooling cavities in the resulting product.

8. The method according to claim 1, wherein the first insert member comprises opposing retaining features, shaped to retain the first insert member in the feature of the solid product once cast.

9. The method according to claim 8, wherein the first insert member comprises outwardly dual tapered portions on either side of a neck portion.

10. The method according to claim 1, wherein the core comprises one or more arm members depending outwardly therefrom and the arm members are received within corresponding locating formations in the mould.

11. The method according to claim 1, wherein the resulting product is a gas turbine engine component.

12. The method according to claim 1, wherein in the solid product, the first insert member extends into but not fully across adjacent cavities.

13. The method according to claim 1, wherein the first insert member includes tapered portions on either side of a neck portion that form a polygonal hourglass shape.

14. The method according to claim 1, wherein the core includes additional insert members.

15. The method according to claim 1, wherein the first insert member is formed of a first ceramic material and the plurality of sections are formed of a second ceramic material, the first ceramic material being different from the second ceramic material.

16. A method of forming a cast product comprising:

providing a core having a plurality of sections and one or more gaps there-between, the core including a first insert member spanning the gap between adjacent sections of the core and directly connected between the adjacent sections of the core so as to hold the adjacent sections in a fixed relative position, the plurality of sections being formed of a ceramic material;

locating the core within a mould;

introducing a liquid phase metal material into the gap between the core sections;

solidifying the liquid phase metal material in the gap so as to form a cast feature of a resulting solid product; and removing the core sections from the solid product to form cavities therein such that the first insert member remains securely held within the feature located between said cavities, wherein the first insert member includes outwardly dual tapered portions on either side of a neck portion.

17. The method according to claim 16, wherein the tapered portions on either side of the neck portion form a polygonal hourglass shape.

18. The method according to claim 16, wherein in the solid product, the first insert member extends into but not fully across adjacent cavities.

19. The method according to claim 16, wherein both ends of the first insert member extend partially into adjacent sections of the core.

20. The method according to claim 16, wherein the core includes additional insert members.

21. The method according to claim 16, wherein the first insert member is formed of a first ceramic material and the plurality of sections are formed of a second ceramic material, the first ceramic material being different from the second ceramic material.

* * * * *